US007169350B2

(12) United States Patent
Norville et al.

(10) Patent No.: US 7,169,350 B2
(45) **Date of Patent: *Jan. 30, 2007**

(54) METHOD AND APPARATUS FOR MAKING A THIXOTROPIC METAL SLURRY

(75) Inventors: Samuel M. D. Norville, Jackson, TN (US); Shaupoh Wang, Jackson, TN (US); Patrick J. Lombard, Jackson, TN (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/043,521

(22) Filed: Jan. 26, 2005

(65) Prior Publication Data

US 2005/0151308 A1 Jul. 14, 2005

Related U.S. Application Data

(63) Continuation of application No. 10/170,803, filed on Jun. 13, 2002, now Pat. No. 6,991,670, which is a continuation of application No. 09/585,502, filed on Jun. 1, 2000, now Pat. No. 6,432,160.

(51) Int. Cl.
*C21B 3/04* (2006.01)
*B22F 9/06* (2006.01)

(52) U.S. Cl. ..... 266/237; 222/595; 164/468

(58) Field of Classification Search ..... 75/333; 164/468; 266/237, 239; 222/595
See application file for complete search history.

(56) References Cited

U.S. PATENT DOCUMENTS

| | | | |
|---|---|---|---|
| 972,429 | A | 10/1910 | Baird |
| 1,506,281 | A | 8/1924 | Baily |
| 1,776,355 | A | 9/1930 | Eppensteiner |
| 2,215,887 | A | 9/1940 | Diegle et al. |
| 2,758,831 | A | 8/1956 | Winter |
| 3,472,502 | A | 10/1969 | Schott |
| 3,523,785 | A | 8/1970 | Gero |

(Continued)

FOREIGN PATENT DOCUMENTS

| | | | |
|---|---|---|---|
| DE | 2424532 | A1 | 12/1975 |

(Continued)

OTHER PUBLICATIONS

U.S. Appl. No. 09/250,824, filed Feb. 17, 1999, Norville et al.

(Continued)

*Primary Examiner*—Scott Kastler
(74) *Attorney, Agent, or Firm*—Andrus, Sceales, Starke & Sawall, LLP

(57) ABSTRACT

An apparatus for producing a thixotropic metallic melt by simultaneously controlledly cooling and stirring the melt to form solid particles of a first phase suspended in a residual liquid second phase. Vigorous stirring of the metallic melt results in the formation of degenerate dendritic particles having substantially spheroidal shapes. The metallic melt is stirred to rapidly and efficiently circulate the forming semi-solid slurry. Circulation of the forming semi-solid slurry results in a substantially uniform temperature throughout. Through precision stirring and cooling, a semi-solid slurry is formed having a first solid phase of about 70–80 wt. % suspended in a second liquid phase.

15 Claims, 7 Drawing Sheets

U.S. PATENT DOCUMENTS 3,730,257 A 5/1973 Haussner
3,735,010 A 5/1973 Turpin
3,791,015 A 2/1974 Lucenti
3,840,364 A 10/1974 Flemings et al.
3,842,895 A 10/1974 Mehrabian et al.
3,882,923 A 5/1975 Alberny et al.
3,902,544 A 9/1975 Flemings et al.
3,948,650 A 4/1976 Flemings et al.
3,951,651 A 4/1976 Mehrabian et al.
3,981,351 A 9/1976 Dompass
3,995,678 A 12/1976 Zavaras et al.
4,088,295 A 5/1978 Medovar et al.
4,089,680 A 5/1978 Flemings et al.
4,106,956 A 8/1978 Bercovici
4,108,643 A 8/1978 Flemings et al.
4,125,364 A 11/1978 Stephens
4,174,214 A 11/1979 Bennett et al.
4,229,210 A 10/1980 Winter et al.
4,281,263 A 7/1981 Virolleau et al.
4,321,958 A 3/1982 Delassus
4,345,637 A 8/1982 Flemings et al.
4,354,831 A 10/1982 Shinkawa et al.
4,415,374 A 11/1983 Young et al.
4,433,715 A 2/1984 Smith
4,434,837 A 3/1984 Winter et al.
4,434,839 A 3/1984 Vogel
4,450,893 A 5/1984 Winter et al.
4,457,354 A 7/1984 Dantzig et al.
4,457,355 A 7/1984 Winter et al.
4,463,795 A 8/1984 Chielens et al.
4,465,118 A 8/1984 Dantzig et al.
4,482,012 A 11/1984 Young et al.
4,494,461 A 1/1985 Pryor et al.
4,510,987 A 4/1985 Collot
4,523,624 A 6/1985 Dantzig et al.
4,524,820 A 6/1985 Gullotti et al.
4,530,404 A 7/1985 Vives
4,534,003 A 8/1985 Manzione
4,555,272 A 11/1985 Ashok et al.
4,565,241 A 1/1986 Young
4,569,218 A 2/1986 Baker et al.
4,607,682 A 8/1986 Dantzig et al.
4,614,225 A 9/1986 Ernst et al.
4,621,676 A 11/1986 Steward
4,669,529 A 6/1987 Evertz et al.
RE32,529 E 10/1987 Vives
4,709,746 A 12/1987 Young et al.
4,712,413 A 12/1987 Koch
4,729,422 A 3/1988 Ernst et al.
4,774,992 A 10/1988 George
4,838,988 A 6/1989 Lang et al.
4,877,079 A 10/1989 Long et al.
4,972,334 A 11/1990 Yamabe et al.
4,989,166 A 1/1991 Akasaka et al.
5,010,501 A 4/1991 Arakawa
5,031,108 A 7/1991 Fujita et al.
5,031,127 A 7/1991 Fujita et al.
5,050,114 A 9/1991 Lee
5,098,487 A 3/1992 Brauer et al.
5,129,035 A 7/1992 Saji et al.
5,135,564 A 8/1992 Fujikawa et al.
5,219,018 A 6/1993 Meyer
5,247,988 A 9/1993 Kurzinski
5,265,040 A 11/1993 Saji et al.
5,315,530 A 5/1994 Gerhardt et al.
5,332,200 A 7/1994 Gorin et al.
5,377,119 A 12/1994 Backer et al.
5,402,366 A 3/1995 Kihara et al.
5,408,638 A 4/1995 Sagawa et al.
5,411,686 A 5/1995 Hata
5,416,795 A 5/1995 Kaniuk et al.
5,425,048 A 6/1995 Heine et al.
5,432,718 A 7/1995 Molvig et al.
5,499,198 A 3/1996 Gaidos et al.
5,501,266 A 3/1996 Wang et al.
5,529,391 A 6/1996 Kindman et al.
5,539,183 A 7/1996 Beckley
5,549,732 A 8/1996 Dube et al.
5,553,206 A 9/1996 Meshkat
5,572,434 A 11/1996 Wang et al.
5,585,067 A 12/1996 Leroy et al.
5,625,579 A 4/1997 Hinsberg et al.
5,630,466 A 5/1997 Garat et al.
5,640,331 A 6/1997 Dahm et al.
5,661,670 A 8/1997 Bharathan et al.
5,701,942 A 12/1997 Adachi
5,732,192 A 3/1998 Malin et al.
5,756,017 A 5/1998 Togawa et al.
5,781,581 A 7/1998 Fishman et al.
5,800,640 A 9/1998 Yamamoto et al.
5,801,969 A 9/1998 Nagahama
5,803,154 A 9/1998 Sugawara et al.
5,819,073 A 10/1998 Nakamura
5,838,587 A 11/1998 Maisotsenko et al.
5,887,640 A 3/1999 Brown et al.
5,899,567 A 5/1999 Morris, Jr.
5,900,080 A 5/1999 Baldi et al.
5,912,823 A 6/1999 Grant
5,925,199 A 7/1999 Shiina et al.
5,940,309 A 8/1999 White et al.
5,953,239 A 9/1999 Teixeira et al.
5,979,534 A 11/1999 Shibata et al.
6,003,585 A 12/1999 Williams et al.
6,003,590 A 12/1999 Pavlicevic et al.
6,009,741 A 1/2000 Wagner
6,019,930 A 2/2000 Baresich
6,021,842 A 2/2000 Bulhoff et al.
6,064,810 A 5/2000 Raad et al.
6,065,526 A 5/2000 Kono
6,165,411 A 12/2000 Adachi et al.
6,399,017 B1 6/2002 Norville et al.
6,402,367 B1 6/2002 Lu et al.
6,432,160 B1 8/2002 Norville et al.
6,443,216 B1 9/2002 Lombard et al.
6,991,670 B2 * 1/2006 Norville et al. ..... 75/333

FOREIGN PATENT DOCUMENTS

DE 19738821 3/1999
EP 0005676 11/1979
EP 0 411 329 A1 2/1991
EP 0 701 002 A1 3/1996
EP 0 710 515 A1 5/1996
EP 0 745 694 A1 12/1996
EP 0 841 406 A1 5/1998
EP 0 903 193 A1 3/1999
EP 0 947 262 A1 10/1999
GB 2 042 386 A 9/1980
GB 2238498 A 6/1991
JP 61-67555 4/1986
JP 1-192446 8/1989
JP 6-28939 2/1994
WO WO 95/19237 7/1995
WO WO 97/21509 6/1997
WO WO 98/23403 6/1998
WO WO 98/30346 7/1998
WO WO 99/12678 A1 3/1999
WO WO 99/50007 10/1999
WO WO 00/05015 2/2000

OTHER PUBLICATIONS

U.S. Appl. No. 09/584,859, filed Jun. 1, 2000, Lombard et al.
U.S. Appl. No. 09/585,061, Jun. 1, 2000, Norville et al.

Wang, S.P., et al., "A Net Inflow Method for Incompressible Viscous Flow with Moving Free Surfaces," pp. 669-694 (Dec. 1994), Int. Jor. For Numerical Methods in Fluids, vol. 18, U.S.

Choi H G et al: "Hybrid numerical method for Navier-Stokes equations based on simple algorithm" Numer heat transfer Party B Fundam; Numerical heat transfer, Part B: Fundamentals Sep. 1995, pp. 155-170, XP008039144, p. 155-161, line 14, figures 1-3.

Patankar, S.V., "Numerical Heat Transfer and Fluid Flow," Hemisphere Publication Corporation, (1980), United States, Dec. 1980.

Saabas H J et al: "Co-located equal-order control-volume finite-element method for multidimensional, incompressible, fluid flow. I. formulation" Numerical heat transfer, Part B (Fundamentals) UK, vol. 26, No. 4, 1994, pp. 381-407, XP008039051, ISSN: 1040-7790, Dec. 1994.

Christon, A Vectorized 3-D Finite Element Model for Transient Simulation of Two-Phase Heat Transport with Phase Transformation and a Moving Interface, IEEE 1990, Dec. 1990.

Felicelli et al., Numberical Simulation of Freckle Formation in Directional Solidification of Binary Alloys, IEEE 1992, Dec. 1992.

Gurnis et al., Finite Element Solution of Thermal Convection on a Hypercube Concurrent Computer, 1988, ACM, Dec. 1988.

Ganzha et al., Symbolic-Numeric Stability Investigations of Jameson's Schemes for the Thin-layer Navier-Stokes Equations, 1994, ACM, Dec. 1994.

Chen, et al. "Simulation of Injection-Compression Mold-Filling Process," Int. Comm. Heat Mass Transfer, (1998), pp. 907-917 vol. 25, No. 7, Dec. 1998.

Sethian et al., Computing Turbulent Flow in complex Geometries on a Massively Parallel Processor, 1991, ACM, Dec. 1991.

Tomovic-M.M. "Simulation Software Makes Metacasting Course More Interesting and Challenging" 1996, p. 1405-1408, vol. 3, IEEE, Dec. 1996.

Vives, C., "Elaboration of Metal Matrix Composites from Thixotropic Allow Slurries using a New Magnetohydrodynamic Caster," Metallurgical Transactions B, Jun. 1993, pp. 493-510, vol 24B, Metallurgical Society of AIME, New York, US.

"Semisolid Metal Process Eliminates Preformed Billets", by Samuel D. Norville, *Die Casting Management*, Mar. 1988, pp. 31-33.

* cited by examiner

METHOD AND APPARATUS FOR MAKING A THIXOTROPIC METAL SLURRY

The present Application is a continuation of pending U.S. patent application Ser. No. 10/170,803, filed Jun. 13, 2002, now U.S. Pat. No. 6,991,670, which is a continuation of U.S. patent application Ser. No. 09/585,502, filed Jun. 1, 2000, now U.S. Pat. No. 6,432,160, the contents of each application hereby being incorporated by reference.

TECHNICAL FIELD OF THE INVENTION

The present invention relates generally to metallurgy, and, more particularly, to a method and apparatus for producing a thixotropic metallic melt through precisely controlled heat transfer and magnetomotive agitation.

BACKGROUND OF THE INVENTION

The present invention relates in general to an apparatus which is constructed and arranged for producing an "on-demand" semi-solid material for use in a casting process. Included as part of the overall apparatus are various stations which have the requisite components and structural arrangements which are to be used as part of the process. The method of producing the on-demand semi-solid material, using the disclosed apparatus, is included as part of the present invention.

More specifically, the present invention incorporates electromagnetic stirring and various temperature control and cooling control techniques and apparata to facilitate the production of the semi-solid material within a comparatively short cycle time. Also included are structural arrangements and techniques to discharge the semi-solid material directly into a casting machine shot sleeve. As used herein, the concept of "on-demand" means that the semi-solid material goes directly to the casting step from the vessel where the material is produced. The semi-solid material is typically referred to as a "slurry" and the slug which is produced as a "single shot" is also referred to as a billet.

It is well known that semi-solid metal slurry can be used to produce products with high strength, leak tight and near net shape. However, the viscosity of semi-solid metal is very sensitive to the slurry's temperature or the corresponding solid fraction. In order to obtain good fluidity at high solid fraction, the primary solid phase of the semi-solid metal should be nearly spherical.

In general, semi-solid processing can be divided into two categories; thixocasting and rheocasting. In thixocasting, the microstructure of the solidifying alloy is modified from dendritic to discrete degenerated dendrite before the alloy is cast into solid feedstock, which will then be re-melted to a semi-solid state and cast into a mold to make the desired part. In rheocasting, liquid metal is cooled to a semi-solid state while its microstructure is modified. The slurry is then formed or cast into a mold to produce the desired part or parts.

The major barrier in rheocasting is the difficulty to generate sufficient slurry within preferred temperature range in a short cycle time. Although the cost of thixocasting is higher due to the additional casting and remelting steps, the implementation of thixocasting in industrial production has far exceeded rheocasting because semi-solid feedstock can be cast in large quantities in separate operations which can be remote in time and space from the reheating and forming steps.

In a semi-solid casting process, generally, a slurry is formed during solidification consisting of dendritic solid particles whose form is preserved. Initially, dendritic particles nucleate and grow as equiaxed dendrites within the molten alloy in the early stages of slurry or semi-solid formation. With the appropriate cooling rate and stirring, the dendritic particle branches grow larger and the dendrite arms have time to coarsen so that the primary and secondary dendrite arm spacing increases. During this growth stage in the presence of stirring, the dendrite arms come into contact and become fragmented to form degenerate dendritic particles. At the holding temperature, the particles continue to coarsen and become more rounded and approach an ideal spherical shape. The extent of rounding is controlled by the holding time selected for the process. With stirring, the point of "coherency" (the dendrites become a tangled structure) is not reached. The semi-solid material comprised of fragmented, degenerate dendrite particles continues to deform at low shear force.

When the desired fraction solid and particle size and shape have been attained, the semi-solid material is ready to be formed by injecting into a die-mold or some other forming process. Solid phase particle size is controlled in the process by limiting the slurry creation process to temperatures above the point at which the solid phase begins to form and particle coarsening begins.

It is known that the dendritic structure of the primary solid of a semi-solid alloy can be modified to become nearly spherical by introducing the following perturbation in the liquid alloy near liquidus temperature or semi-solid alloy:

1) Stirring: mechanical stirring or electromagnetic stirring;
2) Agitation: low frequency vibration, high-frequency wave, electric shock, or electromagnetic wave;
3) Equiaxed Nucleation: rapid under-cooling, grain refiner;
4) Oswald Ripening and Coarsening: holding alloy in semi-solid temperature for a long time.

While the methods in (2)–(4) have been proven effective in modifying the microstructure of semi-solid alloy, they have the common limitation of not being efficient in the processing of a high volume of alloy with a short preparation time due to the following characteristics or requirements of semi-solid metals:

High dampening effect in vibration.
Small penetration depth for electromagnetic waves.
High latent heat against rapid under-cooling.
Additional cost and recycling problem to add grain refiners.
Natural ripening takes a long time, precluding a short cycle time.

While most of the prior art developments have been focused on the microstructure and rheology of semi-solid alloy, temperature control has been found by the present inventors to be one of the most critical parameters for reliable and efficient semi-solid processing with a comparatively short cycle time. As the apparent viscosity of semi-solid metal increases exponentially with the solid fraction, a small temperature difference in the alloy with 40% or higher solid fraction results in significant changes in its fluidity. In fact, the greatest barrier in using methods (2)–(4), as listed above, to produce semi-solid metal is the lack of stirring. Without stirring, it is very difficult to make alloy slurry with the required uniform temperature and microstructure, especially when the there is a requirement for a high volume of the alloy. Without stirring, the only way to heat/cool semi-solid metal without creating a large temperature difference is to use a slow heating/cooling process. Such a process often requires that multiple billets of feedstock be processed simultaneously under a pre-programmed furnace and conveyor system, which is expensive, hard to maintain, and difficult to control.

While using high-speed mechanical stirring within an annular thin gap can generate high shear rate sufficient to break up the dendrites in a semi-solid metal mixture, the thin gap becomes a limit to the process's volumetric throughput. The combination of high temperature, high corrosion (e.g. of molten aluminum alloy) and high wearing of semi-solid slurry also makes it very difficult to design, to select the proper materials and to maintain the stirring mechanism.

Prior references disclose the process of forming a semi-solid slurry by reheating a solid billet forming by thixocasting or by directly from the melt using mechanical or electromagnetic stirring. The known methods for producing semi-solid alloy slurries include mechanical stirring and inductive electromagnetic stirring. The processes for forming a slurry with the desired structure are controlled, in part, by the interactive influences of the shear and solidification rates.

In the early 1980's, an electromagnetic stirring process was developed to cast semi-solid feedstock with discrete degenerate dendrites. The feedstock is cut to proper size and then remelt to semi-solid state before being injected into mold cavity. Although this magneto hydrodynamic (MHD) casting process is capable of generating high volume of semi-solid feedstock with adequate discrete degenerate dendrites, the material handling cost to cast a billet and to remelt it back to a semi-solid composition reduces the competitiveness of this semi-solid process compared to other casting processes, e.g. gravity casting, low-pressure die-casting or high-pressure die-casting. Most of all, the complexity of billet heating equipment, the slow billet heating process and the difficulties in billet temperature control have been the major technical barriers in semi-solid forming of this type.

The billet reheating process provides a slurry or semi-solid material for the production of semi-solid formed (SSF) products. While this process has been used extensively, there is a limited range of castable alloys. Further, a high fraction of solids (0.7 to 0.8) is required to provide for the mechanical strength required in processing with this form of feedstock. Cost has been another major limitation of this approach due to the required processes of billet casting, handling, and reheating as compared to the direct application of a molten metal feedstock in the competitive die and squeeze casting processes.

In the mechanical stirring process to form a slurry or semi-solid material, the attack on the rotor by reactive metals results in corrosion products that contaminate the solidifying metal. Furthermore, the annulus formed between the outer edge of the rotor blades and the inner vessel wall within the mixing vessel results in a low shear zone while shear band formation may occur in the transition zone between the high and low shear rate zones. There have been a number of electromagnetic stirring methods described and used in preparing slurry for thixocasting billets for the SSF process, but little mention has been made of an application for rheocasting.

The rheocasting, i.e., the production by stirring of a liquid metal to form semi-solid slurry that would immediately be shaped, has not been industrialized so far. It is clear that rheocasting should overcome most of limitations of thixocasting. However, in order to become an industrial production technology, i.e., producing stable, deliverable semi-solid slurry on-line (i.e., on-demand) rheocasting must overcome the following practical challenges: cooling rate control, microstructure control, uniformity of temperature and microstructure, the large volume and size of slurry, short cycle time control and the handling of different types of alloys, as well as the means and method of transferring the slurry to a vessel and directly from the vessel to the casting shot sleeve.

While propeller-type mechanical stirring has been used in the context of making a semi-solid slurry, there are certain problems or limitations. For example, the high temperature and the corrosive and high wearing characteristics of semi-solid slurry make it very difficult to design a reliable slurry apparatus with mechanical stirring. However, the most critical limitation of using mechanical stirring in rheocasting is that its small throughput cannot meet the requirements of production capacity. It is also known that semi-solid metal with discrete degenerated dendrite can also be made by introducing low frequency mechanical vibration, high-frequency ultra-sonic waves, or electric-magnetic agitation with a solenoid coil. While these processes may work for smaller samples at slower cycle time, they are not effective in making larger billet because of the limitation in penetration depth. Another type of process is solenoidal induction agitation, because of its limited magnetic field penetration depth and unnecessary heat generation, it has many technological problems to implement for productivity. Vigorous electromagnetic stirring is the most widely used industrial process permits the production of a large volume of slurry. Importantly, this is applicable to any high-temperature alloys.

Two main variants of vigorous electromagnetic stirring exist, one is rotational stator stirring, and the other is linear stator stirring. With rotational stator stirring, the molten metal is moving in a quasi-isothermal plane; therefore, the degeneration of dendrites is achieved by dominant mechanical shear. U.S. Pat. No. 4,434,837, issued Mar. 6, 1984 to Winter et al., describes an electromagnetic stirring apparatus for the continuous making of thixotropic metal slurries in which a stator having a single two pole arrangement generates a non-zero rotating magnetic field which moves transversely of a longitudinal axis. The moving magnetic field provides a magnetic stirring force directed tangentially to the metal container, which produces a shear rate of at least 50 $sec^{-1}$ to break down the dendrites. With linear stator stirring, the slurries within the mesh zone are re-circulated to the higher temperature zone and remelted, therefore, the thermal processes play a more important role in breaking down the dendrites. U.S. Pat. No. 5,219,018, issued Jun. 15, 1993 to Meyer, describes a method of producing thixotropic metallic products by continuous casting with polyphase current electromagnetic agitation. This method achieves the conversion of the dendrites into nodules by causing a refusion of the surface of these dendrites by a continuous transfer of the cold zone where they form towards a hotter zone.

It is known in the art that thixotropic metal melts may be produced by agitating a cooling metal melt. As the metal melt approaches its liquidus temperature, a particulate sold phase begins to precipitate out. As the melt cools, the amount of solid phase increases relative to the remaining liquid phase. Also, the composition at the liquid phase may vary as a function of its the ratio of the amount of remaining liquid phase to the total amount of solid and liquid phases. The viscosity of the cooling melt is sensitive to its temperature, its solid-to-liquid ratio, the composition of the remaining liquid phase, and the relative size, number, and shape of the solid particles. In particular, if the forming solid particles are irregular, the viscosity of the forming semi-solid slurry tends to be substantially greater than if the particles are spherical or spheroid. The viscosity of the semi-solid slurry is even greater if the forming metallic particles are dendritic.

It is well known that a semi-solid metallic slurry may be produced having substantially regularly shaped particles by agitating the cooling melt to degenerate the forming dendrites. Known agitation techniques include mechanical stirring, vibration, induction agitation, undercooling, and high-voltage electric pulse injection. However, these techniques do not address the issue of maintaining the slurry at a uniform, equilibrated temperature. If temperature differentials exist within the melt, the distribution and growth of the solid particulate phase will be irregular and the viscosity of the slurry will likewise be non-uniform. Moreover, temperature differentials in the slurry increase the likelihood of the onset of cascade crystallization of all or part of the slurry. This is especially true with regard to the formation of a solid metallic skin around the slurry, since heat extraction from the slurry occurs primarily at the container-slurry interface.

Another disadvantage with the known techniques and apparata for producing semi-solid slurries is that they are ill suited for continuous or large-scale processing. In addition to the above-described disadvantages, the prior art techniques take on the order of 6–8 minutes to process a molten metal charge into a thixotropic slurry ready for molding. Moreover, the known techniques necessitate a step for transferring molten metal from a melting furnace into a separate stirring vessel, exposing the molten metal to ambient gasses and increasing the possibility of reaction contaminants forming in the liquid metal.

There is therefore a need for a system capable of both quickly and efficiently producing molten metal charge and of mixing the melt to produce a thermally equilibrated thixotropic metal slurry ready for molding from the molten metal charge under a controlled atmosphere. The present invention addresses this need in a novel and unobvious manner.

SUMMARY OF THE INVENTION

The present invention relates to a method and apparatus for producing a thixotropic metallic melt by simultaneously controlledly cooling and stirring the melt such that solid particles of a first phase begin to precipitate in a residual liquid second phase. Dendritic growth of the solid particles is curtailed by vigorously stirring the metallic melt, resulting in degenerate dendritic particles having a substantially spheroidal character. The metallic melt is stirred such that the metal is rapidly and efficiently circulated, so as to quickly reach a substantially uniform temperature throughout. Through precision stirring and cooling, the metallic melt is maintained with about 70–80% of the melt being solid spheroidal particles of a first phase suspended in a liquid medium of a second phase.

One form of the present invention is an apparatus for forming a molten metal mass from solid metal processors under an inert gas atmosphere, automatically transferring a portion of the molten metal mass into a mixing chamber, and rapidly cooling and stirring the transferred portion of molten metal to form a thixotropic semi-solid metallic slurry suitable for molding.

One object of the present invention is to provide an improved system for the production of a thixotropic metallic melt comprising a first phase of degenerate dendritic solid particles suspended in a second liquid phase, wherein the first phase comprises about 70–80 percent of the melt. Related objects and advantages of the present invention will be apparent from the following description.

DETAILED DESCRIPTION OF THE PREFERRED EMBODIMENT

Figure 1A:
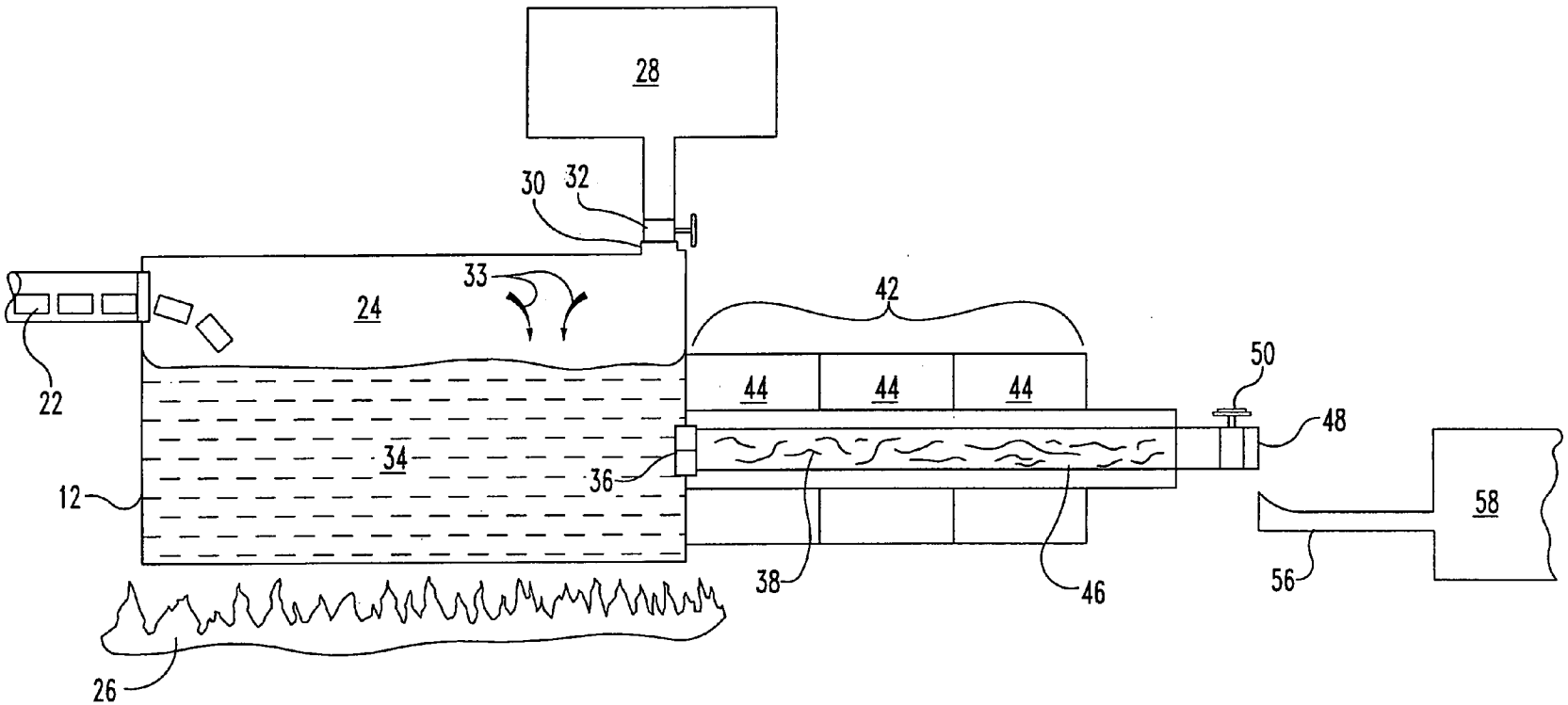
FIG. 1A is a schematic illustration of a first embodiment of the present invention detailing an automatic system for producing a thixotropic semi-solid metal slurry from a molten metal precursor.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

One of the ways to overcome the above challenges, according to the present invention, is to apply modified magnetomotive stirring of substantially the entire liquid metal volume as it solidifies into and through the semi-solid range. Such modified magnetomotive stirring enhances the heat transfer between the liquid metal and its container to control the metal temperature and cooling rate, and generates a sufficiently high shear inside of the liquid metal to modify the microstructure to form discrete degenerate dendrites. Modified magnetomotive stirring increases the uniformity of metal temperature and microstructure by means of increased control of the molten metal mixture. With a careful design of the stirring mechanism and method, the stirring drives and controls a large volume and size of semi-solid slurry, depending on the application requirements. Modified magnetomotive stirring allows the cycle time to be shortened through increased control of the cooling rate. Modified magnetomotive stirring may be adapted for use with a wide variety of alloys, i.e., casting alloys, wrought alloys, MMC, etc.

It should be noted that one important advantage of the present invention is that the exposure of the molten metal to uncontrolled atmospheres (i.e., oxygen) is minimized, since the melting furnace is connected to the mixing vessel such that a controlled, inert atmosphere can be maintained over the metal at all times subsequent to its entry into the furnace. This reduces the risk of contamination due to the formation of oxide impurities or the like in the highly reactive molten metal charge. Another advantage of the present invention is the elimination of a ladle or other mechanical containment means from the furnace to mixing vessel transfer process. In addition to further reducing the risk of oxidation contamination, the elimination of the ladle eliminates a source of flash inclusion contamination, since residual metal adhering to the ladle may act as a contaminant. This is especially important as the residual metal adhering to the ladle is readily oxidized, thereby rendering the ladle a substantial source of oxide contamination. Moreover, the elimination of the ladle from the system serves to reduce the transfer time of molten metal from the furnace to the mixing vessel, thereby reducing overall system cycle time and increasing efficiency.

Yet another advantage of the present invention arises from the presence of a thermal cooling jacket around the mixing vessel, allowing for a predetermined temperature profile over the length of the mixing vessel. The thermal cooling jacket may be adapted to yield a constant heat transfer profile over its length, or it may be adapted to yield a variable heat transfer profile over its length as a function of any convenient parameter, such as time, melt temperature or melt viscosity. An independently programmable thermal cooling jacket allows for an increased resident time of the metal melt in the mixing vessel, since only part of the vessel content is discharged at once. Increased resident time means more time for better mixing without sacrificing cycle time or efficiency. Control of the heat transfer and/or temperature profiles provides for increased stability and consistency of heat transfer from the mixing vessel and enables better stirring and mixing to maximize product consistency. A part formed according to this invention will typically have equivalent or superior mechanical properties, particularly elongation, as compared to castings formed by a fully liquid-to-solid transformation within the mold, the latter castings having a dendritic structure characteristic of other casting processes.

Figure 1B:
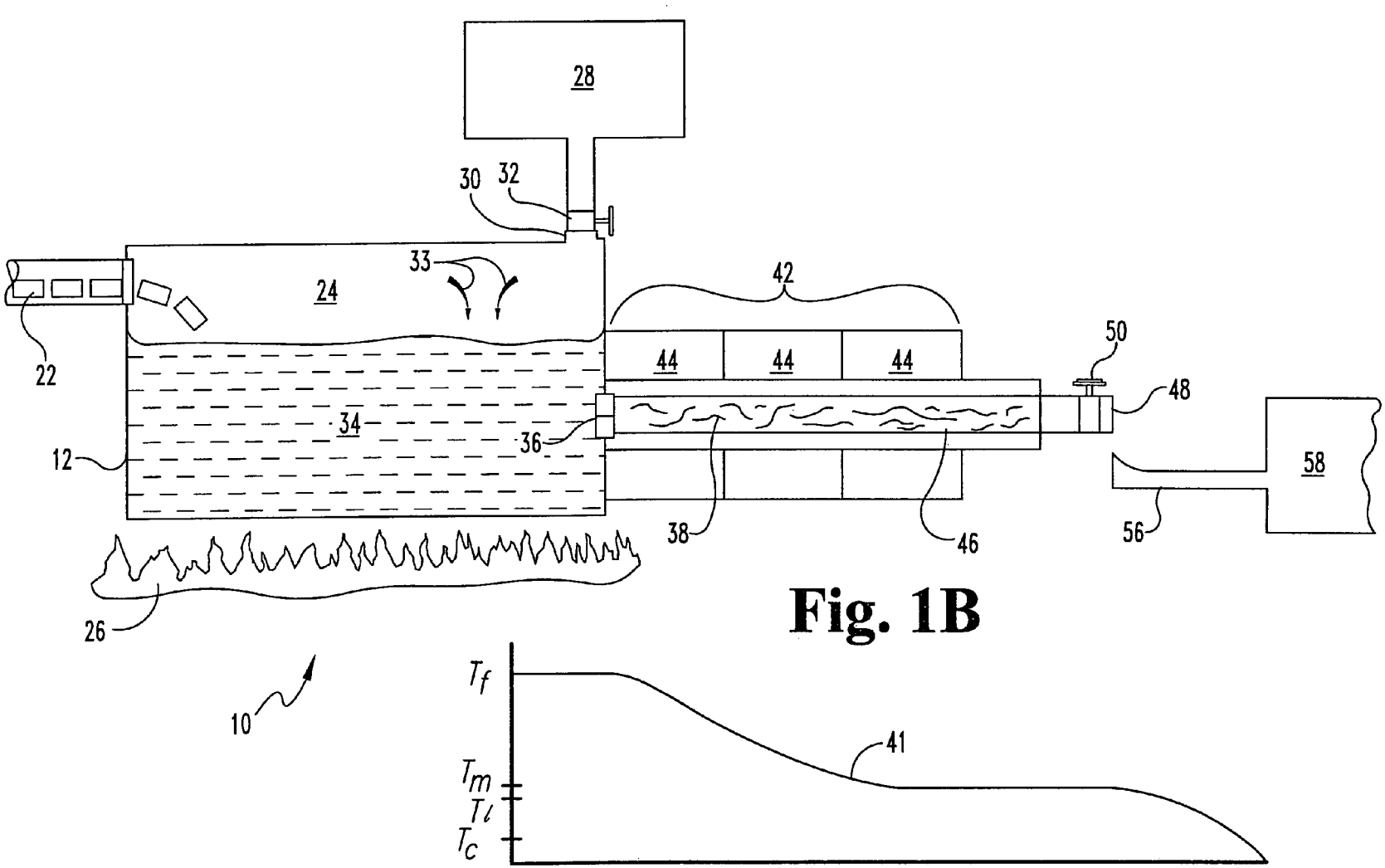
FIG. 1B is a schematic illustration of the embodiment of FIG. 1A, wherein a temperature gradient is maintained along the length of the mixing vessel.

FIGS. 1A and 1B illustrate a first embodiment of the present invention, a system 10 for producing a semi-solid thixotropic metallic slurry from solid metal precursors. The slurry making system 10 includes a metal-melting furnace 12 fluidly connected to a slurry mixing vessel 14. The metal melting furnace is typically capable of holding and melting about 5000–20000 pounds of metal. The operating temperatures of the melting furnace 12 and the mixing vessel 14 are similar, with the mixing vessel 14 maintained at a slightly lower temperature than the melting furnace 12. For example, for processing an aluminum alloy, such as Al357, the melting furnace is preferably maintained at about 630–700° C. and the mixing vessel 14 is maintained at about 580–605° C. In general, the operating temperatures of the system 10 are functions of such variables as the metal composition, the heat generation techniques applied to the furnace 12 and mixing vessel 14, the size of the mixing vessel 14 and melting furnace 12, and the desired throughput speed.

The metal melting furnace 12 includes an inlet port 20 for loading solid metal precursors (ingots) 22 into the furnace interior 24. Preferably, the precursor ingots 22 have the same alloy composition as desired for the end products, however the precursor ingots 22 may be of different compositions in ratios predetermined to form the desired end product alloy composition. Alternately, the inlet port 20 may be used to load premelted liquid metal precursors into the furnace interior 24. One or more heat sources 26 are coupled in thermal communication to the furnace 12 for providing heat sufficient to melt the solid metal precursors 22. A pressurized inert gas supply 28 is connected in fluid communication to a gas inlet 30 formed through the furnace 12, with a gas valve 32 governing the pressure and flow of gas into the furnace 12. Preferably, the pressurized gas is an inert gas, such as nitrogen ($N_2$), although any convenient inert gas (such as argon, helium or the like) may be chosen. The pressurized gas supply 28 may therefore provide a positive pressure inert gas atmosphere 33 above the metal melt 34 formed in the furnace 12 as the solid metal precursors 22 are melted. A mixing vessel inlet 36 formed between the mixing vessel 14 and the melting furnace 12 provides a connection through which fluid communication may occur therebetween.

The mixing vessel 14 defines an interior mixing volume 38. The mixing vessel 14 is substantially surrounded by a thermal jacket 40. The thermal jacket 40 may be unitary, or may be formed of linked sections. The thermal jacket 40 is typically formed from a material having a relatively high melting point and good thermal conductivity (such as bronze, graphite or stainless steel) and includes conduits formed therethrough through which a coolant fluid (such as air, oil, or water) may be flowed. The thermal jacket 40 may also include separate heating means (such as conduits for flowing hot fluids or electric heating rods) to provide precision temperature control. The thermal jacket 40 is connected to the mixing vessel 14 in thermal communication therewith to facilitate rapid heat transfer therebetween. The thermal jacket 40 is preferably used to provide a predetermined temperature profile along the mixing vessel 14, wherein the temperature of the mixing volume 38 is greatest at the mixing vessel inlet 36 and decreases along the length of the mixing vessel 14 according to the temperature curve 41 (see FIG. 1B). However, the mixing volume 38 may be maintained at a substantially constant temperature if so desired. The thermal jacket 40 and mixing vessel 14 are preferably formed from non-magnetic materials to facilitate electromagnetic flux penetration with minimal interference or distortion. A detailed thermal jacket design is provided in the related U.S. patent application Ser. No. 09/584,859, filed on Jun. 1, 2000, by inventors Lombard and Wang, and is incorporated herein by reference.

Figure 1C:
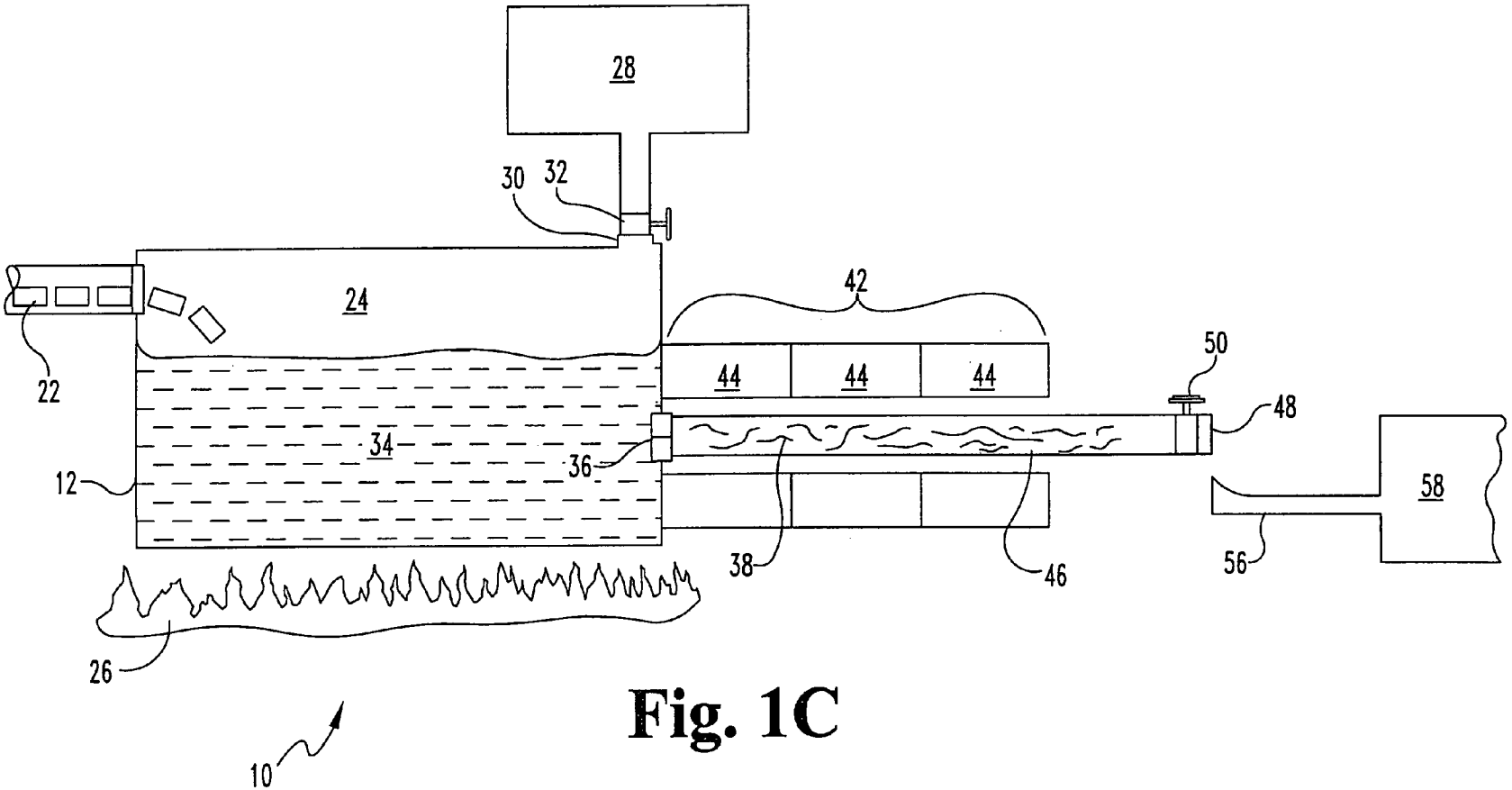
FIG. 1C is a schematic illustration of a second embodiment of the present invention, an automatic system for producing a thixotropic semi-solid metal slurry from a molten metal precursor.

FIG. 1C illustrates an alternate embodiment of the present invention, a system 10' for producing a semi-solid metallic slurry with a solid particulate phase characterized as having degenerated dendrites from solid metal precursors as described above, with the exception that this system 10' does not require a thermal jacket for temperature control. Instead, the mixing vessel 14 is cooled through other means, such as air jets directed at the exterior of the mixing vessel 14.

A stator assembly 42 is also positioned around the mixing vessel 14 such that a magnetomotive force field generated by the stator assembly 42 can substantially permeate the mixing volume 38. As used herein, "magnetomotive" refers to the electromagnetic forces generated to act on an electrically conducting medium to urge it into motion. The stator assembly 42 in each embodiment typically includes a number of individual stators 44 stacked together around the mixing vessel 14. The stator assembly 42 preferably provides a field of varying magnetomotive force, to provide more rapid stirring while the solid fraction of the slurry billet 46 is low and to provide greater stirring force as the solid fraction of the slurry billet 46 increases. However, the stator assembly 42 may, if desired, provide a substantially constant magnetomotive force over the length of the mixing vessel 14. A detailed discussion of magnetomotive mixing is provided in the related U.S. patent application Ser. No. 09/585,060, filed on Jun. 1, 2000, by inventors Lu, Wang and Norville, and is incorporated herein by reference.

During use, a thixotropic semi-solid metallic slurry billet 46 may be formed in the mixing vessel 14. The upstream portion of the slurry billet 46 in the mixing vessel 14 is not yet in a condition ready for discharge from the mixing vessel 14, due to the temperature profile maintained along the length of the mixing vessel 14. Preferably, the thixotropic billet 46 is formed at one end of the mixing vessel 14 (in the case of a mixing vessel 14 having a thermal gradient, at the cool end), but may be formed throughout the mixing vessel 14 (in the case of an isothermal mixing vessel 14.) The slurry billet 46 is formed from a portion of liquid metal transferred into the mixing vessel 14 from the melting furnace 12. The mixing vessel 14 includes a slurry outlet 48 formed therethrough for directly transferring the processed, thixotropic semi-solid billet 46 portion nearest the slurry outlet 48 into a shot sleeve 56 (either directly or by means of an intermediate mechanism). The slurry billet 46 is then immediately transferred from the shot sleeve 56 into a mold 58 via injection molding or the like. Preferably, the slurry billet 46 moving through the mixing vessel 14 is stirred and cooled such that a portion of the slurry billet 46 at and near the slurry outlet 48 is maintained having the desired thixotropic properties to molding; when desired, the slurry outlet is opened, a measured portion of the thixotropic billet 46 is discharged onto the shot sleeve 56, and the slurry outlet 48 is closed.

In operation, the slurry making system 10 typically receives a predetermined amount solid metal ingots 22 through an inlet port 20. The solid metal ingots 22 are preferably of the same composition as desired for the final billet 46, but they may alternately have different compositions preselected to form the desired slurry composition upon melting. The furnace is heated to a predetermined temperature $T_f$ to melt the solid metal precursors 22 into a pool of low viscosity molten metal 34, having a desired composition and temperature $T_f$. An inert gas is introduced into the furnace during the melting process to minimize contamination of the metal melt 34 from oxidation and other chemical reactions.

Once the metal melt 34 has reached the desired temperature $T_f$ (and, accordingly, a desired relatively low viscosity) a predetermined portion of the molten metal 34 (e.g., the slurry billet 46) is transferred into the mixing vessel 14. It is preferable that for each slurry billet charged into the mixing vessel 14, an equal mass of precursor metal ingots 22 is added to the melting furnace 12. Alternately, new metal ingots 22 may be added at regularly scheduled intervals or metal ingots 22 may be added to the melting furnace 12 continuously. In this embodiment, the mixing vessel inlet 36 comprises a valve that may be opened to allow liquid metal to flow from the melting furnace 12 into the mixing vessel 14. However, the mixing vessel inlet 36 may also be provided as a gate, as an aperture positioned such that liquid metal may flow therethrough only after the level of the melt 34 reaches a certain depth, as a small aperture positioned between the furnace 12 and the mixing vessel 14 such that the surface tension of the molten metal or gas pressure differential between the furnace 12 and the mixing vessel 14 prevents flow through the mixing vessel inlet 36 unless positive gas pressure 33 is applied thereto, or by any other transfer means convenient to the design choice.

Once the molten metal charge 34 has been measuredly transferred into the mixing vessel 14, the stator assembly 42 is activated to generate a magnetomotive force field sufficient to stir the entire forming slurry billet 46. This process may be either incremental or continuous. The magnetomotive force field is preferably non-uniform in strength, such that the portion of the slurry billet 46 nearest the mixing vessel inlet 36 (i.e., the lower solid fraction portion) is stirred rapidly to achieve mixing and cooling, while the portion of the slurry billet 46 further away from the inlet 36 (i.e., the higher solid fraction portion) is stirred more slowly due to the higher shear magnetomotive stirring force necessary to keep the slurry in motion. However, the magnetomotive force field may be maintained having a constant (albeit variable) strength, such that the entire billet is stirred at a uniform rate. As the slurry billet 46 is stirred, its temperature is controlledly decreased from $T_f$ by the thermal jacket 40. Preferably, the billet temperature is maintained according to the temperature curve 41, wherein the substantially flat portion of the curve 41 represents the portion of the slurry billet 46 ready for molding. The thermal jacket 40 quickly removes heat from the slurry billet 46 such that the billet temperature rapidly decreases to a point $T_m$ a few degrees above its liquidus point $T_1$. Preferably, the slurry billet 46 is cooled at a rate of between about 0.1° C. per second to about 10° C. per second, and more preferably at a rate from about 0.1° C. per second to about 3° C. per second. As the slurry billet 46 is cooled, it is continuously stirred by the magnetomotive force field generated by the stator set 42 to maintain the slurry billet 46 at a substantially uniform temperature/stirring profile at any point in the mixing volume 14. In other words, a cross-section of the slurry billet 46 is maintained at a substantially homogeneous temperature as it moves through the mixing vessel 14, indicated by the corresponding point on temperature curve 41. However, as the billet temperature decreases, the volume percent of solid phase of the slurry billet 46 increases, as does its viscosity. Although for a given magnetomotive force field an increase in billet viscosity will likewise be accompanied by a decrease in stirring rate, it is desirable to control the strength of the magnetomotive force field to more precisely control the stirring rate of the slurry billet 46 as it cools close to its liquidus temperature.

Once the slurry billet 46 has been stirred and cooled to a desired temperature $T_m$, viscosity, and volume fraction of solid phase particles, the portion of the slurry billet 46 that now behaves as a semi-solid thixotropic metallic slurry is transferred upon demand from the mixing vessel 14 by means of the slurry outlet 48 into a waiting shot sleeve 56. The slurry outlet 48 preferably includes a slurry valve 50 sufficient to control the portions of the slurry billet 46 discharged and to maintain an inert gas atmosphere within the slurry maker system 10. Once transferred to the shot sleeve 56, the slurry billet 46 is immediately transferred into a mold 58, wherein it is cast into a desired final form. The casting process is performed rapidly, and is completed before the slurry billet 46 cools below its liquidus temperature $T_1$ to some temperature $T_c$ at which it no longer behaves thixotropically. A typical slurry billet 46 may be processed as described above in about 5 to 100 seconds.

Figure 2A:
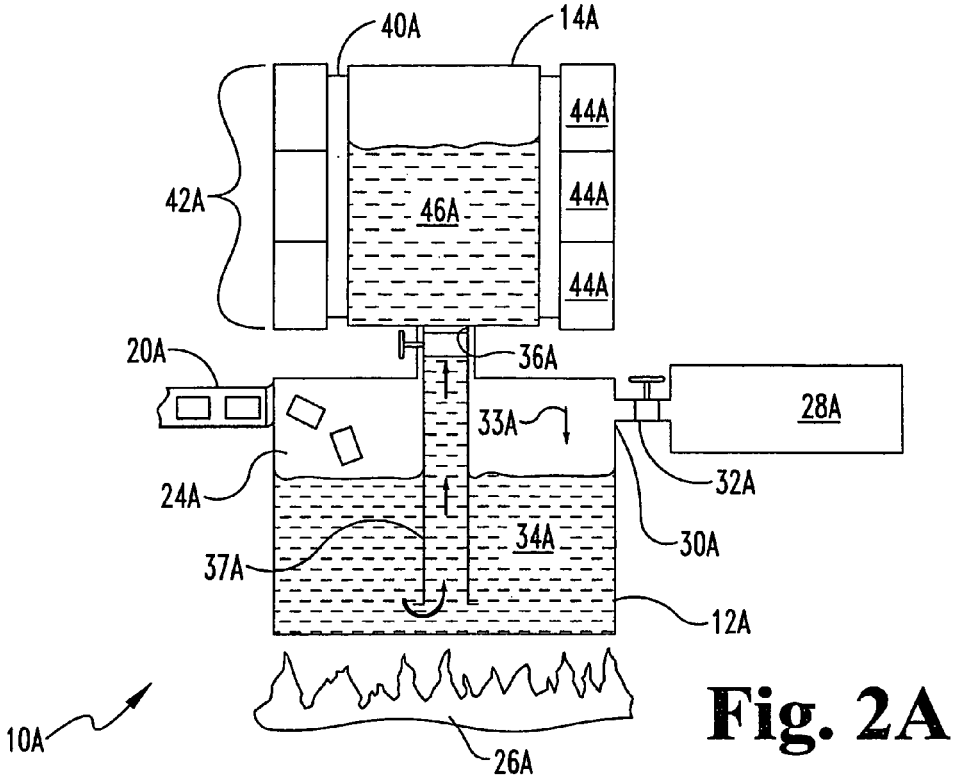
FIG. 2A is a schematic illustration of a third embodiment of the present invention detailing an automatic system for producing a thixotropic semi-solid metal slurry from a molten metal precursor.

FIG. 2A illustrates a second embodiment of the present invention, a system 10A for producing a semi-solid thixotropic metallic slurry from metal precursors 22A (preferably ingots). The slurry making system 10A includes a metal-melting furnace 12A fluidically connected to a slurry mixing vessel 14A. The metal melting furnace 12A includes a metal inlet port 20A for loading solid metal ingots 22A or the like into the furnace interior 24A. One or more heat sources 26A are coupled in thermal communication to the furnace 12A for providing heat sufficient to melt the solid metal precursors 22A. An inert gas supply 28A is connected in fluid communication to a gas inlet formed through the furnace 22A, with a gas valve 32A governing the flow of gas into the furnace 22A. The inert gas supply 28A preferably provides a positive pressure inert gas atmosphere 33A above the metal melt 34*a* formed in the furnace 22A as the solid metal precursors 22A are melted. A mixing vessel inlet 36A formed between the mixing vessel 14A and the melting furnace 12A provides a connection through which fluid communication may occur therebetween. A sprue or pipe 37A extends upwardly from the melting furnace 12A into the mixing vessel 14A. Liquid metal may be controlledly forced from the melting furnace 12A up the sprue 37A and into the mixing vessel 14A by increasing the inert gas pressure 33A upon the metal melt 34A. Preferably, the mixing vessel inlet 36A comprises a valve operable to allow liquid metal to fill the mixing vessel 14*a* and further operable to contain the liquid metal within the mixing vessel 14A in isolation from the melting furnace 12A.

The mixing vessel 14A defines an interior mixing volume 38A positioned above the melting furnace 12A. The mixing vessel may be positioned directly above the melting furnace (see FIGS. 2A–2B) or the mixing vessel may be horizontally displaced from the melting furnace 12A (see FIG. 3).

The mixing vessel 14A is substantially surrounded by a thermal jacket 40A. The thermal jacket 40A may be unitary, or may be formed of linked sections. The thermal jacket 40A is typically formed from a material having a relatively high melting point and good thermal conductivity (such as bronze or stainless steel) and includes conduits formed therethrough through which a coolant fluid (such as air, oil, or water) may be flowed. The thermal jacket 40A may also include separate heating means (such as conduits for flowing hot fluids or electric heating rods) to provide precision temperature control. The thermal jacket 40A is connected to the mixing vessel 14A in thermal communication therewith to facilitate rapid heat transfer therebetween.

Figure 2B:
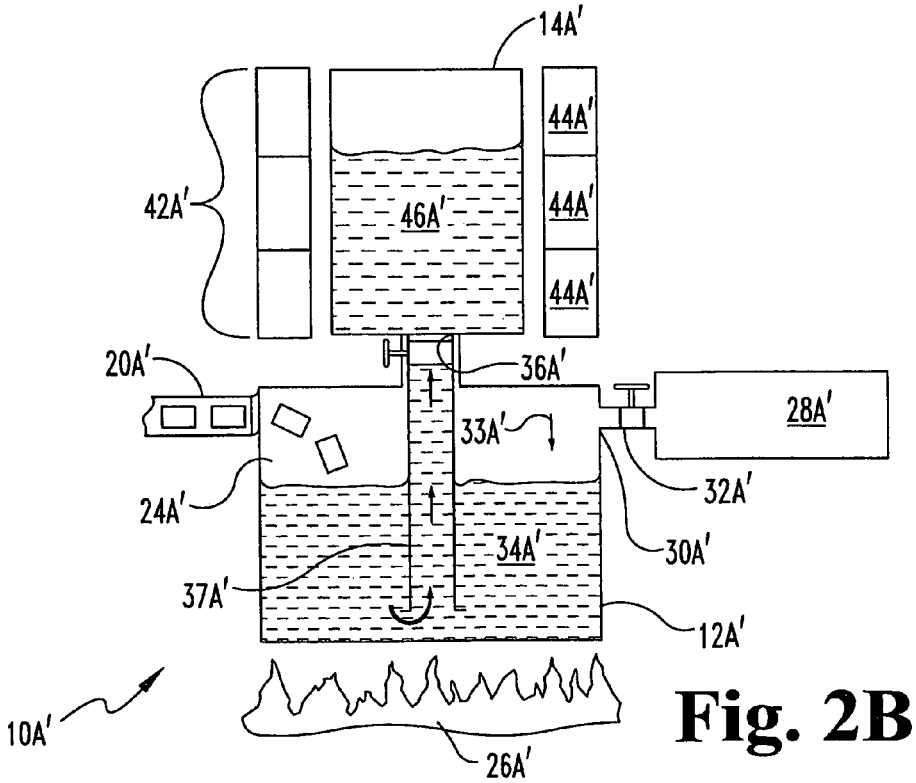
FIG. 2B is a schematic illustration of a fourth embodiment of the present invention detailing an automatic system for producing a thixotropic semi-solid metal slurry from a molten metal precursor.
Figure 3:
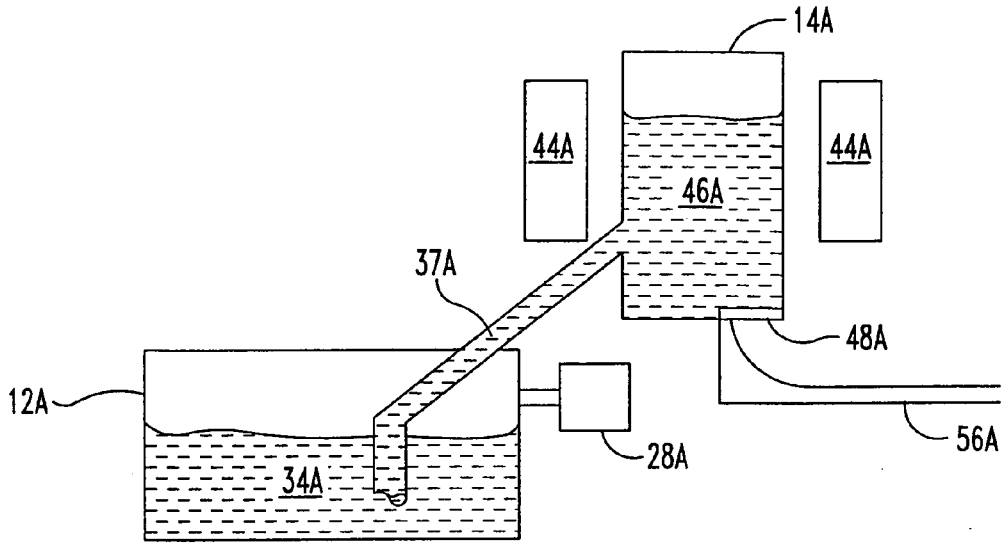
FIG. 3 is a schematic illustration of the FIG. 2A embodiment wherein the mixing vessel is horizontally displaced from the melting furnace.

Alternately, as shown in FIG. 2B, the system 10A' may be cooled without the use of a thermal jacket for temperature control. Instead, the mixing vessel 14A' is cooled through other means, such as air jets directed at the exterior of the mixing vessel 14A'.

A stator assembly 42A is also positioned around the mixing vessel 14A such that a magnetomotive force field generated by the stator assembly 42A can substantially permeate the mixing volume 38A. The stator assembly 42A typically includes a number of individual stators 44A stacked together around the mixing vessel 14A.

Figure 4:
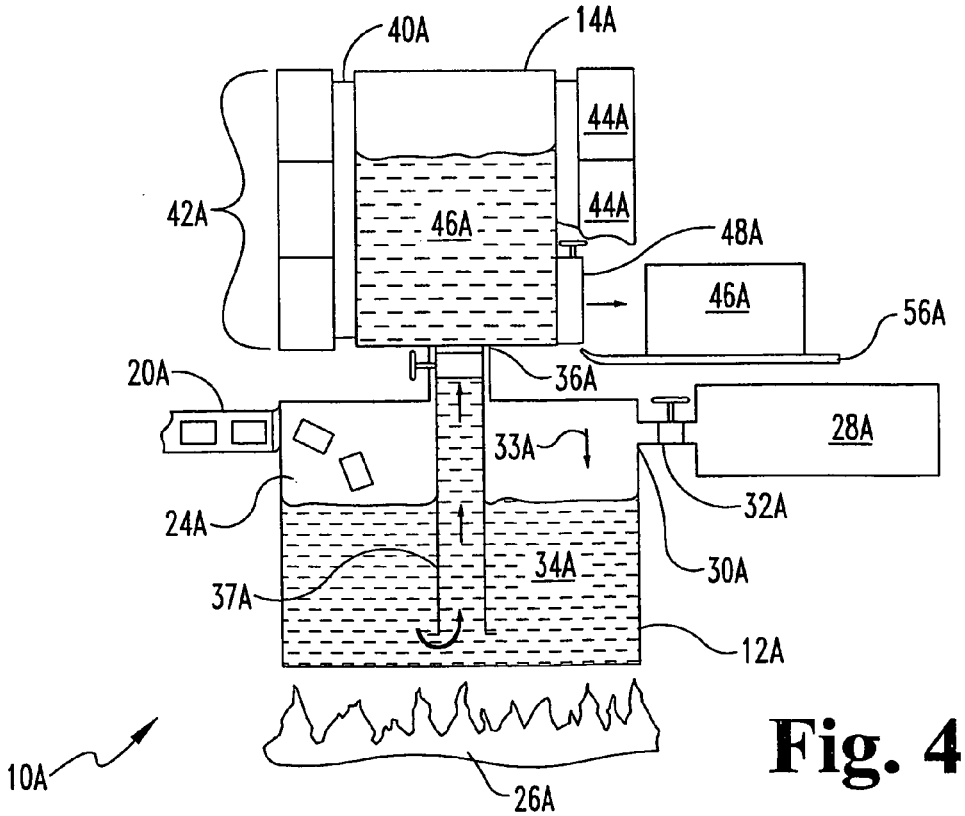
FIG. 4 is a schematic illustration of the FIG. 2A embodiment wherein the mixing vessel is adapted to discharge the billet onto a shot sleeve.

During use, a semi-solid metallic slurry billet 46A having a suspended solid particulate phase characterized by degenerated dendrites may be formed in the mixing vessel 14A. The slurry billet 46A is formed from a portion of liquid metal transferred into the mixing vessel 14A from the melting furnace 12A. The mixing vessel includes a slurry outlet 48A formed therethrough for transferring the processed, thixotropic semi-solid billet 46A into a shot sleeve 56A, from where the slurry billet 46A is immediately transferred into a mold 58A. The slurry outlet 48A may comprise an aperture formed atop the mixing vessel 14A through which the slurry billet 46A may be discharged (when the mixing vessel is tilted—see FIG. 2C) or the slurry outlet 48A may comprise an aperture formed in the side or bottom of the mixing vessel 14A through which the slurry billet 46A may be discharged (see FIG. 4). Alternately, the mixing vessel 14A may be detachable, such that a robot arm can be used to grab the mixing vessel 14A, to move the mixing vessel 14A to a desired location, and to tilt the mixing vessel 14A to facilitate discharge of the slurry billet 46A.

Figure 2C:
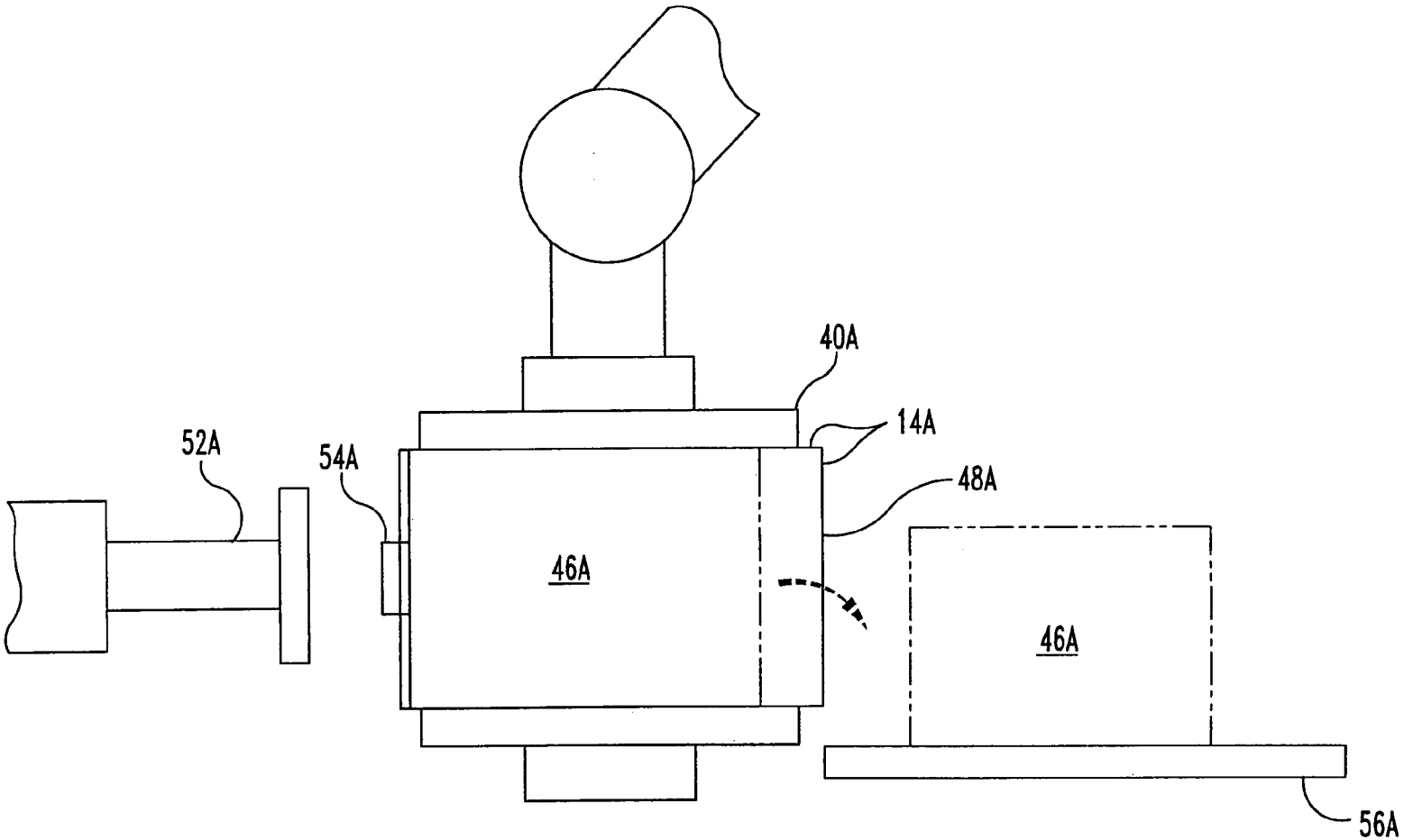
FIG. 2C is a schematic illustration of a fifth embodiment of the present invention detailing an automatic system for producing a thixotropic semi-solid metal slurry from a molten metal precursor.

As illustrated in FIG. 2C, a robot arm assembly 50A is used to move the mixing vessel 14A from its mixing position (i.e., connected to the sprue 37A and in liquid communication with the melting furnace 12A) to a discharge position, wherein the mixing vessel 14A is aligned with a piston 52A adapted to engage the bottom portion 54A of the mixing vessel 14A and move the bottom portion 54A therethrough to discharge the slurry billet 46A onto a waiting shot sleeve 56A. In this embodiment, the bottom portion 54A is adapted to be pushed through the mixing vessel 14A. Alternately, the slurry billet 46A may be discharged by tilting the mixing vessel 14A (with or without the assistance of the robot arm 50A) to utilize gravity to force the slurry billet 46A onto a shot sleeve 56A or the like.

In operation, the slurry making system 10A receives a predetermined amount solid metal precursors 22A through an inlet port 20A. The solid metal precursors 22A may be of the same composition as desired for the final billet 46A, or they may have different compositions selected to form the desired slurry composition upon melting. The furnace is heated to a predetermined temperature to melt the solid metal precursors 22A into a pool of molten metal 34A, having a desired composition and temperature. An inert gas is introduced into the furnace during the melting process to minimize contamination of the metal melt 34A from oxidation and other chemical reactions.

Once the metal melt 34A has reached a desired temperature (and, accordingly, a desired relatively low viscosity) a predetermined portion of the metal melt 34A (e.g., the slurry billet 46A) is transferred into the mixing vessel 14A. In this embodiment, the mixing vessel inlet 36A includes a sprue 37A positioned to connect the lower melting furnace 12A to the raised mixing vessel 14A in fluidic communication. Positive gas pressure 33A is applied above the melt 34A, forcing liquid metal up the sprue 37A and into the mixing vessel 14A. Precise control of the inert gas pressure 33A allows precise measurement of the amount of liquid metal flowing into the mixing vessel to form a billet 46A.

Once the slurry billet 46A has been measuredly transferred into the mixing vessel 14A, the stator assembly 42A is activated to generate a magnetomotive force field sufficient to rapidly stir the entire billet 46A. As the slurry billet 46A is stirred, its temperature is controlledly decreased by the thermal jacket 40A. The thermal jacket 40A quickly removes heat from the slurry billet 46A such that the billet temperature rapidly decreases to a point a few degrees above its liquidus point, and then the temperature is further decreased as a solid phase forms in the liquid matrix. As the slurry billet 46A is cooled, it is continuously stirred by the magnetomotive force field generated by the stator set 42A to maintain the slurry billet 46A at a substantially uniform temperature. However, as the billet temperature decreases, the volume percent of solid phase of the slurry billet 46A increases, as does its viscosity. Although for a given magnetomotive force field an increase in billet viscosity will likewise be accompanied by a decrease in stirring rate, it is desirable to control the strength of the magnetomotive force field to more precisely control the stirring rate of the slurry billet 46A as it cools close to its liquidus temperature.

Once the slurry billet 46A has been stirred and cooled to a desired temperature, viscosity, and volume fraction of solid phase particles, the slurry billet 46A (now a semi-solid thixotropic metallic slurry) is transferred from the mixing vessel 14A by means of the slurry outlet 48A into a waiting shot sleeve 56A. The slurry outlet 48A preferably includes a slurry valve 50A sufficient to maintain an inert gas atmosphere within the slurry maker system 10A. Once transferred to the shot sleeve 56A, the slurry billet 46A is immediately transferred into a mold 58A, wherein it is cast into a desired final form.

Figure 5:
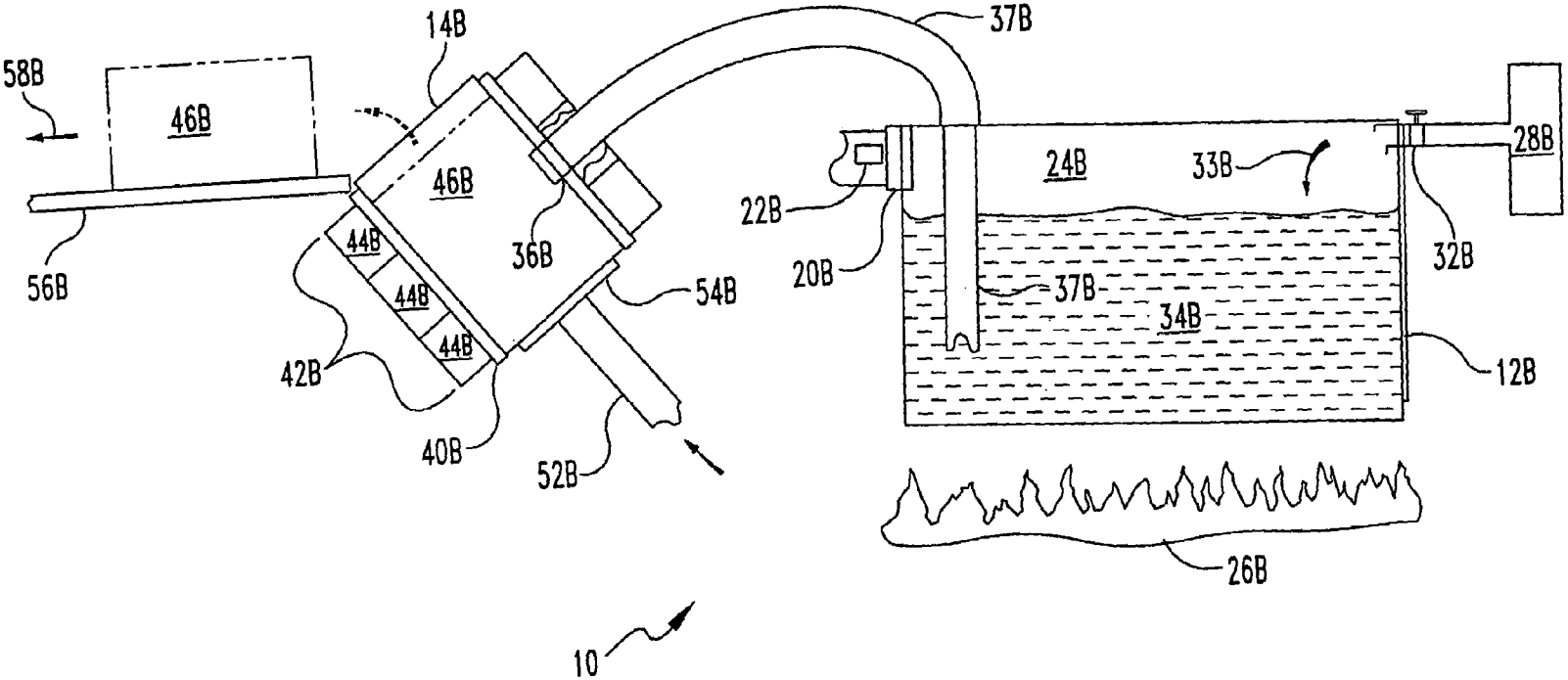
FIG. 5 is a schematic illustration of a sixth embodiment of the present invention, an automatic system for producing a thixotropic semi-solid slurry from a molten metal precursor.

FIG. 5 illustrates a third embodiment of the present invention, a system 10B for producing a semi-solid thixotropic metallic slurry from metal precursors 22B (again, preferably ingots). As in the case of the previous embodiments, the slurry making system 10B includes a metal-melting furnace 12B fluidically connected to a slurry mixing vessel 14B. The metal melting furnace 12B includes a metal inlet port 20B for loading solid metal ingots 22B or the like into the furnace interior 24B. One or more heat sources 26B are coupled in thermal communication to the furnace 12B for providing heat sufficient to melt the solid metal precursors 22B. The heat sources may be gas-fed flame jets, electrical resistance or inductance coils, or any convenient heating apparati. An inert gas supply 28B is connected in fluidic communication to a gas inlet formed through the furnace 22B, with a gas valve 32B governing the flow of gas into the furnace 22B. The inert gas supply 28B preferably provides a positive pressure inert gas atmosphere 33B above the metal melt 34B formed in the furnace 22B as the solid metal precursors 22B are melted. A mixing vessel inlet 36B formed between the mixing vessel 14B and the melting furnace 12B provides a connection through which fluid communication may occur therebetween. A sprue or pipe 37B extends from the melting furnace 12B into the mixing vessel 14B. Liquid metal may be controlledly forced from the melting furnace 12B through the sprue 37B and into the mixing vessel 14B by sufficiently increasing the inert gas pressure 33B upon the metal melt 34B. In this embodiment, the sprue 37B is curved, such that liquid flowing out of either the mixing vessel 14B or the melting furnace 12B must first flow against the pull of gravity. In other words, the curve and positioning of the sprue relative the mixing and melting vessels 14B, 12B provides an added safety benefit, reducing the likelihood of accidental transfer of molten metal therebetween. Preferably, the mixing vessel inlet 36B comprises a valve operable to allow liquid metal to fill the mixing vessel 14B and further operable to contain the liquid metal within the mixing vessel 14B in isolation from the melting furnace 12B.

The mixing vessel 14B defines an interior mixing volume 38B positioned near, and preferably elevated at least slightly above, the melting furnace 12B. The mixing vessel 14B may be substantially surrounded by a thermal jacket 40B. The thermal jacket 40B may be unitary, or may be formed of linked sections. The thermal jacket 40B is typically formed from a material having a relatively high melting point and good thermal conductivity (such as bronze or stainless steel) and includes conduits formed therethrough through which a coolant fluid (such as air, oil, or water) may be flowed. The thermal jacket 40B may also include separate heating means (such as conduits for flowing hot fluids or electric heating rods) to provide precision temperature control. The thermal jacket 40B is connected to the mixing vessel 14B in thermal communication therewith to facilitate rapid heat transfer therebetween. In the absence of a thermal jacket 40B, the mixing vessel 14B may be cooled through other means, such as air jets directed at the exterior of the mixing vessel 14B.

A stator assembly 42B is also positioned around the mixing vessel 14B such that a magnetomotive force field generated by the stator assembly 42B can substantially permeate the mixing volume 38B. The stator assembly 42B typically includes a number of individual stators 44B stacked together around the mixing vessel 14B.

During use, a semi-solid metallic slurry billet 46B having a suspended solid particulate phase characterized by degenerated dendrites may be formed in the mixing vessel 14B. The slurry billet 46B is formed from a portion of liquid metal transferred into the mixing vessel 14B from the melting furnace 12B. The mixing vessel includes a slurry outlet 48B formed therethrough for transferring the processed, thixotropic semi-solid billet 46B into a shot sleeve 56B, from where the slurry billet 46B may be easily and immediately transferred into a mold. The slurry outlet 48B preferably comprises an aperture formed atop the mixing vessel 14B through which the slurry billet 46B may be discharged, although the slurry outlet 48B may comprise an aperture formed in the side or bottom of the mixing vessel 14B. Alternately, the mixing vessel 14B may be detachable, such that a robot arm can be used to grab the mixing vessel 14B, to move the mixing vessel 14B to a desired location, and to tilt the mixing vessel 14B to facilitate discharge of the slurry billet 46B.

Preferably, a piston 52B is positioned in contact with the bottom portion 54B of the mixing vessel 14B, which is adapted to either move through the mixing vessel 14B or yield to the piston 52B. Preferably, the piston 52B engages the bottom portion 54B of the mixing vessel 14B, pushing the bottom portion 54B and the slurry billet 46B through the mixing vessel 14B until the slurry billet 46B emerges onto the shot sleeve 56B. Alternately, the slurry billet 46B may be discharged by tilting the mixing vessel 14B to utilize gravity to force the slurry billet 46B onto a shot sleeve 56B or the like.

In operation, the slurry making system 10B receives a predetermined amount solid metal precursors 22B through an inlet port 20B. The solid metal precursors 22B may be of the same composition as desired for the final billet 46B, or they may have different compositions selected to form the desired slurry composition upon melting. The furnace is heated to a predetermined temperature to melt the solid metal precursors 22B into a pool of molten metal 34B, having a desired composition and temperature. An inert gas is introduced into the furnace during the melting process to minimize contamination of the metal melt 34B from oxidation and other chemical reactions.

Once the metal melt 34B has reached a desired temperature (and, accordingly, a desired relatively low viscosity) a predetermined portion of the metal melt 34B (e.g., the slurry billet 46B) is transferred into the mixing vessel 14B. In this embodiment, the mixing vessel inlet 36B includes a sprue 37B positioned to connect the melting furnace 12B to the spaced mixing vessel 14B in fluidic communication. Positive gas pressure 33B is applied above the melt 34B, forcing liquid metal through the sprue 37B and into the mixing vessel 14B. Precise control of the inert gas pressure 33B allows precise measurement of the amount of liquid metal flowing into the mixing vessel to form a billet 46B.

Once the slurry billet 46B has been measuredly transferred into the mixing vessel 14B, the stator assembly 42B is activated to generate a magnetomotive force field sufficient to rapidly stir the entire billet 46B. As the slurry billet 46B is stirred, its temperature is controlledly decreased by the thermal jacket 40B. The thermal jacket 40B quickly removes heat from the slurry billet 46B such that the billet temperature rapidly decreases to a point a few degrees above its liquidus point, and then the temperature is further decreased as a solid phase forms in the liquid matrix. As the slurry billet 46B is cooled, it is continuously stirred by the magnetomotive force field generated by the stator set 42B to maintain the slurry billet 46B at a substantially-uniform temperature. However, as the billet temperature decreases, the volume percent of solid phase of the slurry billet 46B increases, as does its viscosity. Although for a given magnetomotive force field an increase in billet viscosity will likewise be accompanied by a decrease in stirring rate, it is desirable to control the strength of the magnetomotive force field to more precisely control the stirring rate of the slurry billet 46B as it cools close to its liquidus temperature.

Once the slurry billet 46B has been stirred and cooled to a desired temperature, viscosity, and volume fraction of solid phase particles, the slurry billet 46B (now a semi-solid thixotropic metallic slurry) is transferred from the mixing vessel 14B by means of the slurry outlet 48B into a waiting shot sleeve 56B. The slurry outlet 48B preferably includes a slurry valve 50B sufficient to maintain an inert gas atmosphere within the slurry maker system 10B. Once transferred to the shot sleeve 56B, the slurry billet 46B is immediately transferred into a mold 58B, wherein it is cast into a desired final form.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for producing a metallic slurry material for use in semi-solid forming, comprising:

a furnace adapted to contain a molten metal;

a vessel positioned and arranged to receive a select amount of the molten metal directly from said furnace and adapted to process said select amount of the molten metal into a semi-solid slurry billet; and a shot sleeve positioned and arranged to receive at least a portion of the semi-solid slurry billet directly from said vessel and adapted to transfer the at least a portion of the semi-solid slurry billet into a mold for substantially immediate forming into a shaped part, wherein said vessel is positioned in direct fluid communication with said furnace.

2. The apparatus of claim 1 wherein said vessel is detachably coupled to said furnace.

3. An apparatus for producing a metallic slurry material for use in semi-solid forming, comprising:

a furnace adapted to contain a molten metal;

a vessel positioned and arranged to receive a select amount of the molten metal directly from said furnace and adapted to process said select amount of the molten metal into a semi-solid slurry billet;

a shot sleeve positioned and arranged to receive at least a portion of the semi-solid slurry billet directly from said vessel and adapted to transfer the at least a portion of the semi-solid slurry billet into a mold for substantially immediate forming into a shaped part; and a positioning element constructed and arranged to reposition said vessel between a substantially vertical orientation for receiving said select amount of the molten metal, and a non-vertical orientation for discharging said at least a portion of the semi-solid slurry billet into said shot sleeve.

4. An apparatus for producing a metallic slurry material for use in semi-solid forming, comprising:

a furnace adapted to contain molten metal;

a vessel positioned and arranged to receive a select amount of the molten metal from said furnace while in a substantially vertical orientation and adapted to process said select amount of the molten metal into a semi-solid slurry billet;

a positioning element constructed and arranged to reposition said vessel between said substantially vertical orientation and a non-vertical orientation; and a shot sleeve positioned and arranged to receive at least a portion of the semi-solid slurry billet discharged from said vessel while said vessel is in said non-vertical orientation and adapted to transfer the at least a portion of the semi-solid slurry billet into a mold for substantially immediate forming into a shaped part.

5. The apparatus of claim 4 further comprising:

a cooling element arranged in thermal communication with said vessel to controllably cool said molten metal within said vessel; and a magnetic field generator positioned adjacent said vessel and adapted to produce a magnetic field that acts upon the molten metal to stir the molten metal within said vessel during controlled cooling to form the semi-solid slurry billet.

6. The apparatus of claim 4 wherein said vessel is positioned in direct fluid communication with said furnace.

7. The apparatus of claim 4 wherein said vessel is detachably coupled to said furnace.

8. The apparatus of claim 4 wherein said positioning element comprises a robotic arm adapted to reposition said vessel between said substantially vertical orientation and said non-vertical orientation.

9. The apparatus of claim 4 wherein said positioning element comprises a tilting mechanism adapted to reposition said vessel between said substantially vertical orientation and said non-vertical orientation.

10. The apparatus of claim 4 further comprising a discharging element constructed and arranged to discharge said at least a portion of said semi-solid slurry billet from said vessel while said vessel is in said non-vertical orientation.

11. The apparatus of claim 4 wherein said shot sleeve is positioned in immediate communication with vessel to receive said at least a portion of the semi-solid slurry billet directly from said vessel.

12. A method for producing a metallic slurry material for use in semi-solid forming, comprising:

providing a furnace containing a liquid metal;

providing a vessel;

transferring a select amount of the liquid metal from the furnace directly into the vessel;

transforming at least a portion of the select amount of the liquid metal within the vessel into a semi-solid slurry billet;

transferring at least a portion of the semi-solid slurry billet from the vessel directly into the shot sleeve; and substantially immediately forming at least a portion of the slurry billet into a shaped part.

13. The method of claim 12 wherein the transforming comprises electromagnetically stirring the liquid metal within the vessel while cooling the liquid metal at a controlled cooling rate.

14. The method of claim 12 further comprising positioning the vessel in direct fluidic communication with the furnace prior the transferring.

15. The method of claim 12 wherein the vessel includes an outlet adapted to open and close, the method further comprising:

closing the outlet to maintain the select amount of the liquid metal within the vessel; and opening the outlet to allow the at least a portion of the slurry billet to be discharged from the vessel.

* * * * *